US007641478B2

(12) United States Patent
Cheng

(10) Patent No.: US 7,641,478 B2
(45) Date of Patent: Jan. 5, 2010

(54) CARD BUS CONNECTOR ASSEMBLY

(75) Inventor: Yung-Chang Cheng, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/286,308

(22) Filed: Sep. 29, 2008

(65) Prior Publication Data

US 2009/0093139 A1 Apr. 9, 2009

(30) Foreign Application Priority Data

Oct. 8, 2007 (TW) ..... 96216775 U

(51) Int. Cl.
*H01R 12/00* (2006.01)

(52) U.S. Cl. ..... 439/64; 439/630

(58) Field of Classification Search ..... 439/64, 439/73, 79, 328, 159, 630, 633
See application file for complete search history.

(56) References Cited

U.S. PATENT DOCUMENTS 7,080,991 B2 * 7/2006 Wang ..... 439/79
7,125,258 B2 * 10/2006 Nakakubo et al. ..... 439/64
7,351,108 B2 * 4/2008 Ting et al. ..... 439/630
7,357,642 B2 * 4/2008 Masubuchi et al. ..... 439/64

FOREIGN PATENT DOCUMENTS

TW 2766377 6/2007

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

A card bus connector assembly mounted within a housing (40) includes a card bus connector (10) and an electronic card (20) having a number of grounding pads (23) disposed on a bottom surface thereof and a wedge-shaped protruding portion (29) disposed in an end portion of the electronic card. The card bus connector has a base (11) and a grounding plate (4) mounted to a bottom surface of the base. The grounding plate has a number of grounding terminals (431) extending upwardly for engaging with the grounding pads of the electronic card.

5 Claims, 5 Drawing Sheets

CARD BUS CONNECTOR ASSEMBLY

BACKGROUND OF THE INVENTION

1. Field of the Invention

The present invention is directed to a card bus connector assembly mounted within a wedge-shaped housing, and particularly to a card bus connector assembly having a card bus connector for electrically connecting an electronic card to a printed circuit board.

2. Description of Prior Arts

Portable computers equipped with card bus connectors for receiving therein an electronic card which expands the function of the computer have become dominating projects in the market. The card bus connector is mounted on a printed circuit board of the computer and the electronic card has metallic covers. A grounding path must be provided between the electronic card and the printed circuit board so that when the electronic card is inserted into the card bus connector, electrostatic charges accumulated on the metallic covers of the electronic card can be discharged therethrough.

Taiwan Patent No. 314456 issued on Jun. 21, 2007, discloses such a card connector for electrically connecting an electronic card to a printed circuit board. The card connector is mounted within a computer housing of rectangular configuration and comprises a header connector having a base and a number of terminals mounted into the base, a grounding plate assembled to an upper portion of the base in a top-to-bottom direction and having a plurality of ground contacts extending downwardly to electrically connecting with a plurality of contacts disposed on the electronic card. More recently, the computer housing is of wedge-shaped configuration. During assembly, the electronic card which has a wedge-shaped protruding portion disposed at end portion thereof resists against the housing. Thus, the electronic card cannot be completely inserted into the card connector for electrically connecting with the printed circuit board.

Hence, it is desirable to provide an improved card bus connector assembly to overcome the aforementioned disadvantages.

SUMMARY OF THE INVENTION

An object of the present invention is to provide a card bus connector assembly having a card bus connector mounted within a wedge-shaped housing and adapted for insertion of an electronic card having a wedge-shaped protruding portion.

To achieve the above object, a card bus connector assembly mounted within a housing has a card bus connector and an electronic card mounted into the card bus connector for connecting to a printed circuit board. The electronic card has a plurality of first contacts mounted therein, a plurality of grounding pads disposed on a bottom surface thereof. The card bus connector has a base, a plurality of second contacts mounted into the base for engaging with the first contacts, a grounding plate mounted to a bottom surface of the base and having a plurality of grounding terminals extending upwardly for engaging with the grounding pads of the electronic card. The card bus connector further has an ejector mechanism for moving the electronic card to an ejected position and a shield enclosing the housing.

The grounding plate is mounted to a bottom portion of the header connector. When the electronic card having the wedge-shaped protruding portion dispose on the end portion thereof and the grounding pads disposed on the bottom surface thereof is inserted into the housing, the grounding terminals of the grounding plate could be in electrical communication with the grounding pads of the electronic card.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
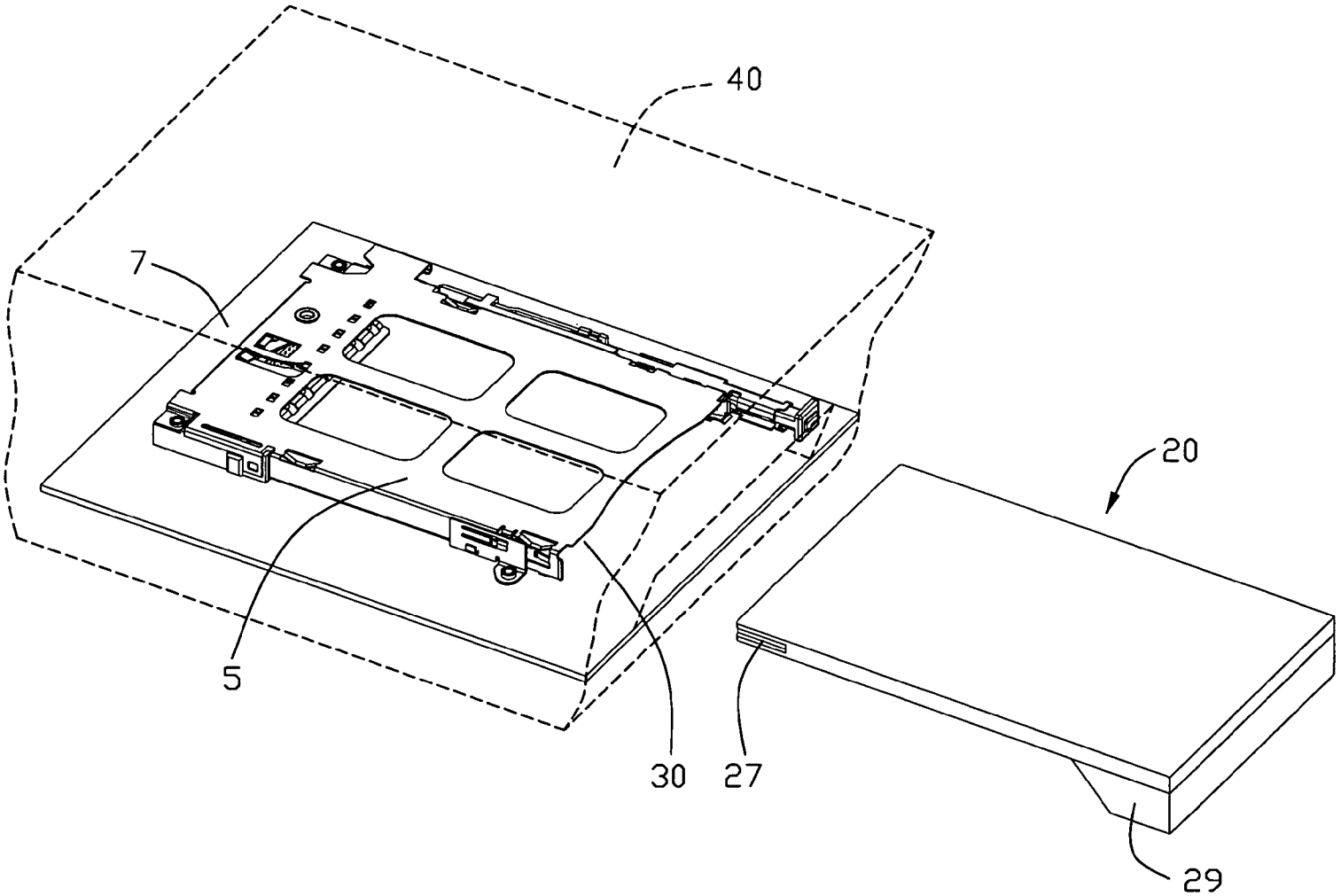
FIG. 1 is an assembled perspective view of a card bus connector assembly mounted within a wedge-shaped housing of the present invention.

Reference will now be made to the drawing figures to describe the present invention in detail. Referring to FIG. 1, a card bus connector assembly mounted within a wedge-shaped housing 40 for connecting to a printed circuit board 7 comprises a card bus connector 10 and an electronic card 20 inserted into the card bus connector 10.

Figure 2:
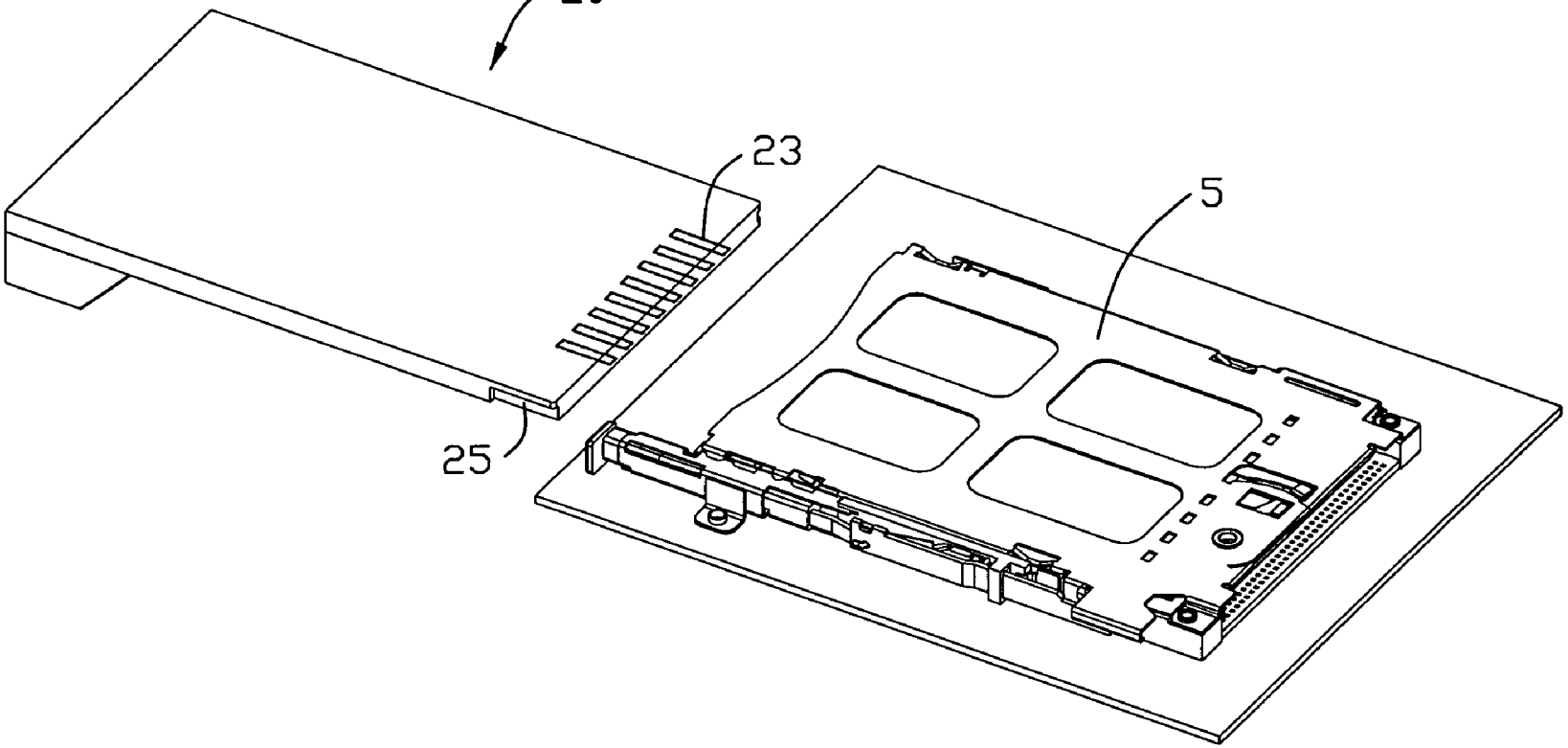
FIG. 2 is an assembled perspective view of card bus connector assembly when an electronic card is not inserted into the card bus connector.

Referring FIGS. 1 and 2, the electronic card 20 has a plurality of first contacts (not shown) mounted therein, a plurality of grounding pads 23 disposed on a bottom surface thereof and a wedge-shaped protruding portion 29 disposed on an end portion thereof for coupling with the wedge-shaped housing 40. The electronic card 20 further has a pair of recesses 25, 27 defined on opposite side edge portions thereof.

Figure 3:
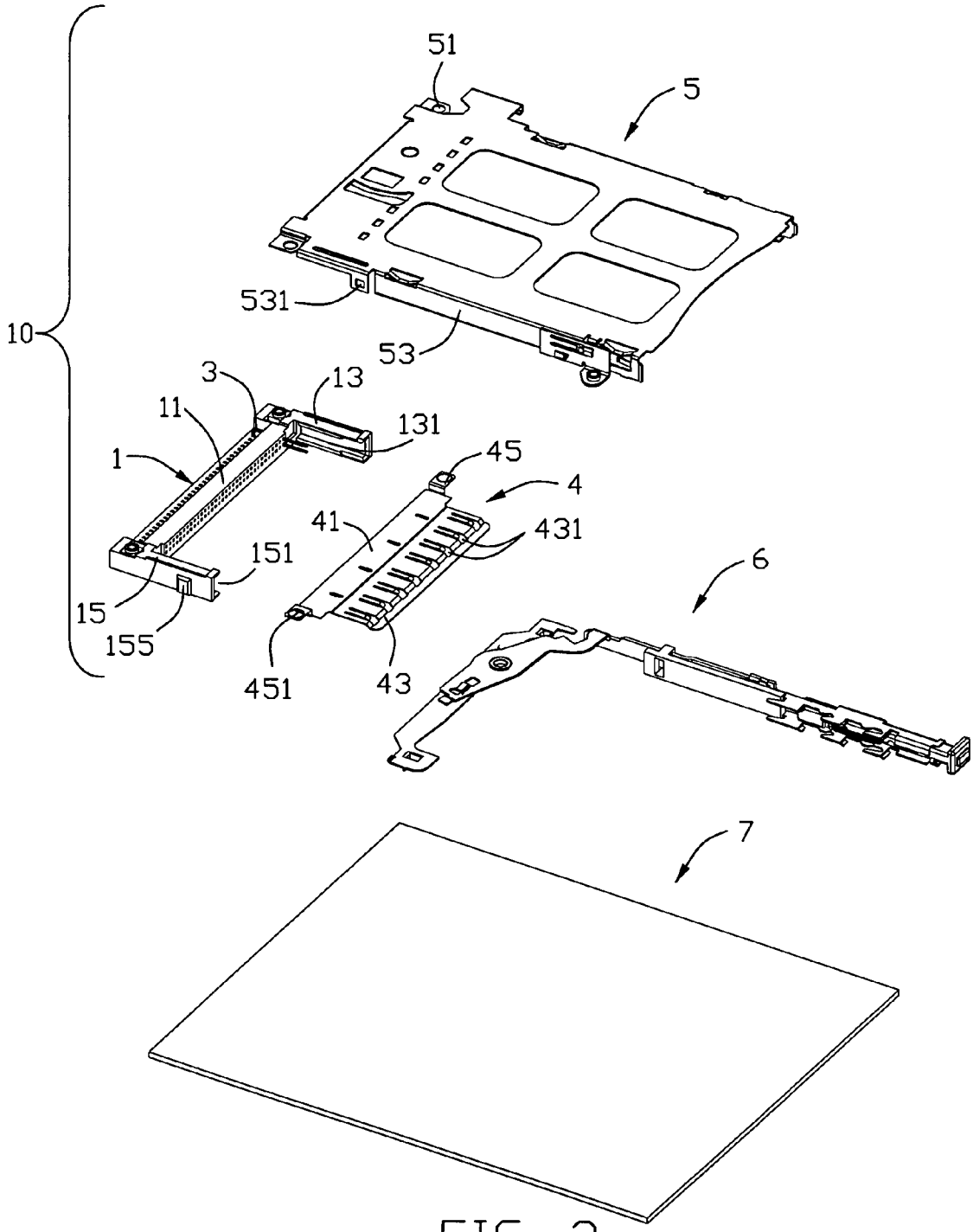
FIG. 3 is an exploded perspective view of the card bus connector and a printed circuit board.

Referring to FIG. 3, the card bus connector 10 has a header connector 1 comprising a base 11 and a plurality of second contacts (not shown) mounted into the base 11 for engaging with the first contacts of the electronic card. The card bus connector 10 further has a grounding plate 4 mounted to a bottom portion of the base 11, an ejector mechanism 6 operatively associated with the header connector 1 for moving the electronic card 20 to an ejected position and a shield 5 enclosing the header connector 1.

Figure 4:
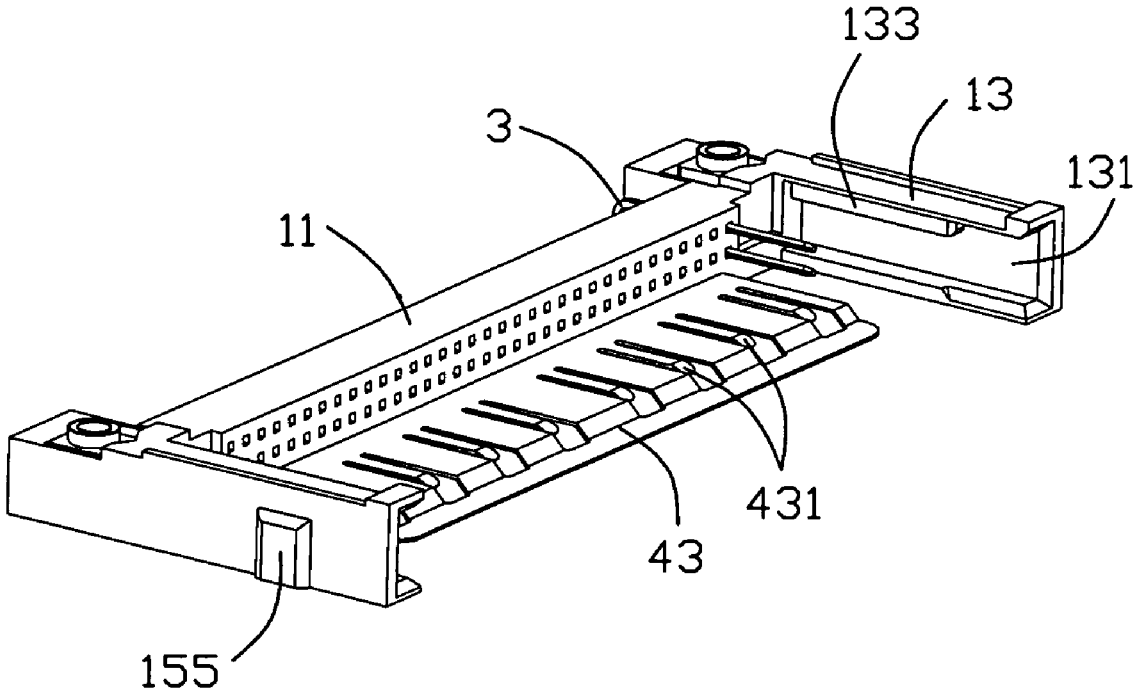
FIG. 4 is a perspective view of a grounding plate mounted to a header connector.
Figure 5:
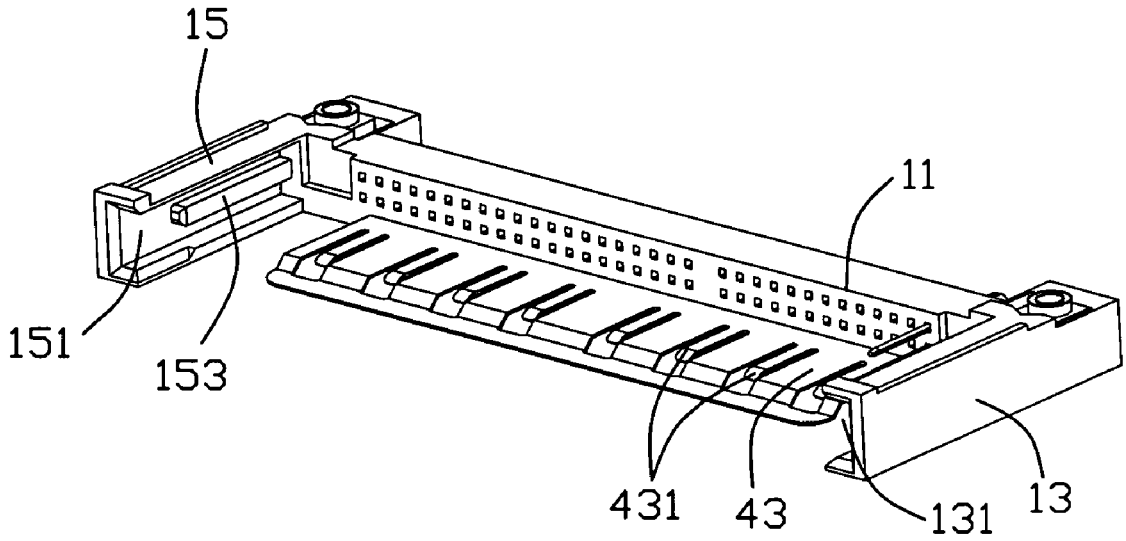
FIG. 5 is another perspective view similar to FIG. 4.

Referring to FIGS. 1, 4 and 5, the base 11 has a pair of first holes (not labeled) defined on opposite corner portions thereof, a first arm 13 and an opposite second arm 15 projecting forwardly and forming a receiving space 30 therebetween for receiving the electronic card 20. The first arm 13 and the second arm 15 respectively has a first guiding slot 131 and a second guiding slot 151 for guiding the electronic card 20. The first arm 13 has a first protrusion 133 disposed on an upper portion of the inner surface of the first slot 131. The second arm 15 includes a second protrusion 153 disposed on a central portion of the inner surface of the second guiding slot 151. The first protrusion 133 and the second protrusion 153 respectively engages with the recesses 25, 27 of the electronic card 20 for anti-mismating.

Referring to FIG. 3, the grounding plate 4 includes a connecting portion 41 mounted to a bottom portion of the base 11, a grounding portion 43 extending forwardly from the connecting portion 41 and having a plurality of grounding terminals 431 extending upwardly for connecting with grounding pads 23 of electronic card 20. The grounding plate 4 further has a pair of ear portions 45 each extending upwardly and outwardly and defining a second hole 451 thereon, corresponding to the first hole.

The shield 5 comprises a pair of third hole 51 defined thereon and a side wall 53 having an opening 531 defined thereon for coupling with the a bulge 155 disposed on the second arm 15.

Referring to FIGS. 1-3, during assembly, firstly, the grounding plate 4 and the shield 5 are respectively mounted to the bottom portion of the base 11 and a top portion of the base 11 by a screw (not shown) inserting through the third hole 51, the first hole and screwing into the second hole 451 of the ear portion 45. Secondly, the electronic card 20 is inserted into the receiving space 30, with the wedge-shaped protruding portion 29 coupling with the wedge-shaped housing 40. The first contacts of the electronic card 20 engage with the second contacts of the base 11 of the header connector 1. The grounding terminals 431 of the grounding plate 43 electrically connect with the grounding pads 23 of the electronic card 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card bus connector assembly mounted within a housing, for connecting to a printed circuit board, comprising: an electronic card having a plurality of first contacts mounted therein and a plurality of grounding pads disposed on a bottom surface thereof; and a card bus connector, comprising: a base; a plurality of second contacts mounted into the base for engaging with the first contacts; a grounding plate mounted to a bottom surface of the base and having a plurality of grounding terminals extending upwardly for engaging with the grounding pads of the electronic card; a shield enclosing the connector; and an ejector mechanism mounted to the shield, wherein said base comprises a first arm and a second arm projecting forwardly from opposite side portions thereof and a receiving space defined therebetween, wherein said first arm and the second arm respectively have a first guiding slot and a second guiding slot for guiding the electronic card, wherein said electronic card has a pair of recesses defined on opposite side edge portions thereof, said first arm has a first protrusion disposed on an upper portion of the inner surface of the first guiding slot, and said second arm includes a second protrusion disposed on a central portion of the inner surface of the second guiding slot for coupling with the recesses, wherein the electronic card comprises a wedge-shaped protruding portion disposed on an end portion thereof for coupling with the housing.

2. The card bus connector assembly as claimed in claim 1, wherein said grounding plate has a connecting portion mounted to the bottom surface of the base, and a grounding portion extending forwardly from the connecting portion.

3. The card bus connector assembly as claimed in claim 2, wherein said grounding plate further has a pair of ear portions each extending upwardly and outwardly from the connecting portion and defining a hole thereon.

4. The card bus connector assembly as claimed in claim 3, further comprising a screw inserting through the hole of the grounding plate for connecting the grounding plate to the base and the shield.

5. An electrical connector assembly comprising: an printed circuit board defining a mounting face thereon; a header having a first surface mounted to the mounting face and including a plurality of terminals therein; a metallic shell mounted on a second surface of the header which is opposite to the first surface under a condition that said shell, said header and said printed circuit board commonly define a card receiving space into which said terminals extend; an ejection mechanism mounted to at least one of said shell and said header; and a metallic grounding plate sandwiched between the printed circuit board and the header around said mounting face and said first surface; wherein said grounding plate defines at least one grounding tang extending into the card receiving space for engagement with a grounding pad formed on an electronic card which is received within the card receiving space, wherein a lever of said ejection mechanism is sandwiched between the shell and the header around said second surface, wherein said mounting face directs upwardly, wherein said grounding plate and said shell are respectively located on two opposite sides of the receiving space in a vertical direction.

* * * * *